US010125451B2

(12) United States Patent
Criante

(10) Patent No.: US 10,125,451 B2
(45) Date of Patent: Nov. 13, 2018

(54) METHOD FOR MARKING REFERENCES ON A FLAT ARTICLE AND A SYSTEM ACTUATING THE METHOD

(71) Applicants: BRAMAC S.r.l., Montegranaro (IT); BIEN Pltd., Petrich (BG); Luigino Criante, Montegiorgio (IT)

(72) Inventor: Luigino Criante, Montegiorgio (IT)

(73) Assignees: BRAMAC S.R.L. (BG); Lugino Criante (IT)

( * ) Notice: Subject to any disclaimer, the term of this patent is extended or adjusted under 35 U.S.C. 154(b) by 0 days.

(21) Appl. No.: 15/300,096

(22) PCT Filed: Apr. 1, 2015

(86) PCT No.: PCT/IB2015/052401

§ 371 (c)(1),
(2) Date: Sep. 28, 2016

(87) PCT Pub. No.: WO2015/151045

PCT Pub. Date: Oct. 8, 2015

(65) Prior Publication Data

US 2017/0183812 A1 Jun. 29, 2017

(30) Foreign Application Priority Data

Apr. 4, 2014 (IT) ..... BO2014A0188

(51) Int. Cl.
*B41J 3/407* (2006.01)
*D06H 1/02* (2006.01)
(Continued)

(52) U.S. Cl.
CPC ..... *D06H 1/02* (2013.01); *A43D 8/00* (2013.01); *B41J 3/4078* (2013.01); *C14B 1/28* (2013.01)

(58) Field of Classification Search
CPC ..... B41J 3/4078; B41J 2/4078; D06H 1/02; A43D 8/00; C14B 1/28
See application file for complete search history.

(56) References Cited

U.S. PATENT DOCUMENTS 1,922,135 A 8/1933 Larsson
3,186,859 A 6/1965 Surowitz
(Continued)

FOREIGN PATENT DOCUMENTS

DE 20 2004 006637 U1 7/2004
WO WO 01/64138 A2 9/2001
WO WO 2005/106104 A1 11/2005

*Primary Examiner* — Jason Uhlenhake
(74) *Attorney, Agent, or Firm* — R. Neil Sudol; Henry D. Coleman

(57) ABSTRACT

A method for marking references on a flat article includes providing a model having at least a through-opening and exhibiting the same peripheral profile as a flat article to be marked; detecting the peripheral profile of the model and storing that profile in a memory; detecting a profile of the through-opening and the relative positioning with respect to a reference system; detecting a peripheral profile of the flat article; replicating the peripheral profile of the model so as to superpose it on the peripheral profile of the flat article; replicating also the profile of the through-opening of the detected model, taking account of the relative positioning with respect to the reference system and of the positioning of the peripheral profile of the model with respect to the peripheral profile of the flat article. Contactless marking of at least a reference on the flat article is made at the profile of the through-opening which has been replicated.

12 Claims, 3 Drawing Sheets

(51) Int. Cl.
*A43D 8/00* (2006.01)
*C14B 1/28* (2006.01)

(56) References Cited

U.S. PATENT DOCUMENTS

| | | | | |
|---|---|---|---|---|
| 4,901,359 | A * | 2/1990 | Bruder | B26D 5/00 235/462.01 |
| 2003/0198897 | A1* | 10/2003 | Nebashi | H01L 21/31144 430/314 |
| 2013/0265350 | A1* | 10/2013 | Costin, Sr. | B41J 3/42 347/2 |

* cited by examiner

METHOD FOR MARKING REFERENCES ON A FLAT ARTICLE AND A SYSTEM ACTUATING THE METHOD

FIELD OF THE INVENTION

The present invention relates to the technical sector of working flat articles (planar articles), for example, though not exclusively, leather or material articles. In detail, the invention further relates to a marking method for marking references on a flat article, and to a system actuating the method.

DESCRIPTION OF THE PRIOR ART

With reference for example to the leather sector, there is a need to assemble two or more flat leather articles in order to enable realising a finished product (footwear, bags, etc.).

For this purpose, each article to be assembled (which has a determined profile) must be marked with references (for example lines or points); these constitute a guide for the operator doing the assembly, who has to perform the sewing (i.e. the "edging") of the various leather articles to one another.

A marking method is known for marking references on flat articles, for example made of leather, which includes the use of cardboard models provided with through-openings.

In particular, for each leather article (which can have a determined profile) a cardboard model is provided with the same profile.

To mark the references on a leather article, a corresponding model is superposed on the article and an operator manually traces the references on the article by tracing a marker pen in the through-holes of the cardboard model, suitably provided.

The known method however has some drawbacks.

With the above-described method the precision of the marking of the references on a flat object is not guaranteed: this depends completely on the experience of the operator performing the operation. In fact, if the marker pen with which the references are marked is not kept perpendicular to the article being marked by the operator, the references will not be correctly traced. Additionally, given the manual nature of the operation, markings cannot be made that are different to the "continuous line" style, with the further drawback that, for example with "difficult" leathers (i.e. particularly thick or rough), an excessive pressure is required of the marker pen on the leather (i.e. on the flat article) in order to leave a mark. This requirement creates further problems in the final stage of finishing the product, due to the difficulty of physically eliminating the signs left by any imprecise markings, including cases where indelible inks are used.

As well as this, the model must be superposed exactly on the flat article: if this is not properly done, the marking operation will not be optimal and especially will not be suitable for the main functionality thereof.

Also worthy of note is that it is often necessary to mark a high number of references on an article: thus long working times are required, including many alignments and markings.

All of the above leads to fatigue for the operator doing the reference marking, which fact has a negative effect on the precision and especially on the total productivity.

SUMMARY OF THE INVENTION

The aim of the present invention is to obviate the above-mentioned drawbacks.

The aim is attained by providing a method for marking references on a flat article according to claim 1 and claim 4, and to a system actuating the above-mentioned method according to claim 5.

The proposed solution advantageously enables marking references on a flat article very precisely, independently of the operator's experience.

Further, with the proposed solution, even where the number of references to be marked is high, the marking operation is particularly rapid. In fact, the delicate steps of pre-aligning necessary in the manual marking operation are completely eliminated to the total advantage of an automatic system of roto-translation able to superpose precisely on the profiles of the through-openings of the model directly on the flat article, marking thereon the right references. The advantage of being able to eliminate a severe constraint of the above-described operation, arbitrarily positioning both the model and the flat article on the respective rest planes, further enables reaching high levels of precision, repeatability and productivity.

A further advantage of the proposed solution consists in the fact that the marking operation (in continuous-line style as well as series of broken lines and/or dots) can be repeated on articles requiring the references, without negatively affecting precision and productivity.

BRIEF DESCRIPTION OF THE DRAWINGS

Specific characteristics of the invention will be described in the following description, with reference to the tables of drawings, in which:

FIGS. 1, 2 and 3 schematically illustrate three steps of a method according to the invention;

DESCRIPTION OF THE PREFERRED EMBODIMENTS

Figure 1A:
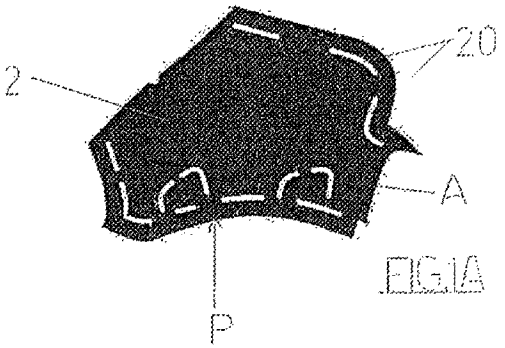
FIG. 1A illustrates a detail of FIG. 1.
Figure 1:
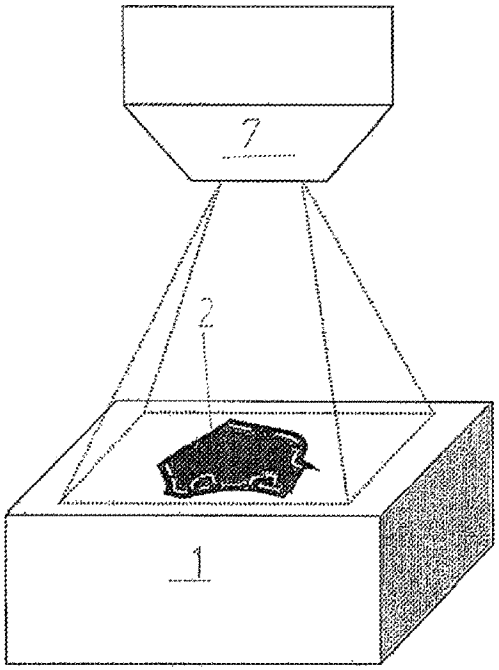
Figure 2:
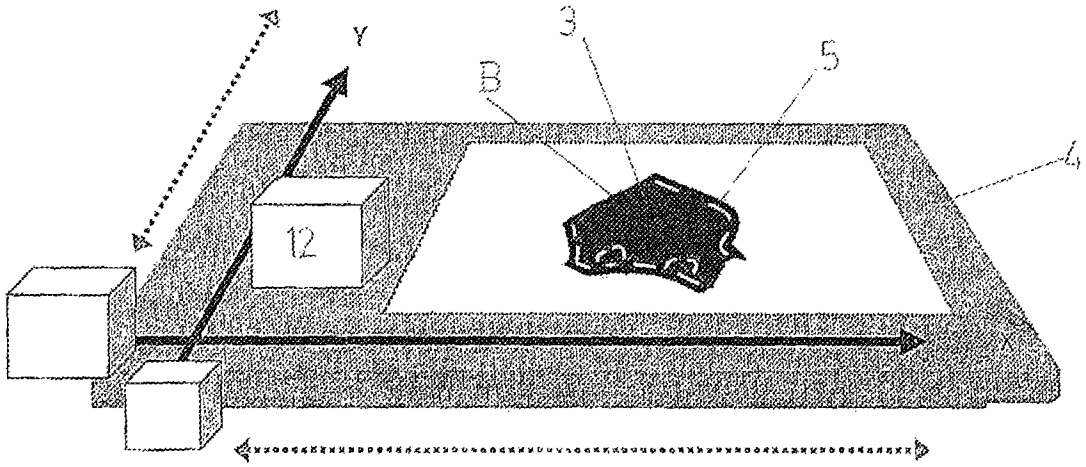

The method for marking references on a flat article according to the invention (with reference to the accompanying figures of the drawings) comprises a step of a) predisposing, on a detecting plane (1), a model (2) provided with at least a through-opening (20), the model (2) exhibiting a same peripheral profile (P) as a flat article (3) to be marked (see FIG. 1).

Figure 2:
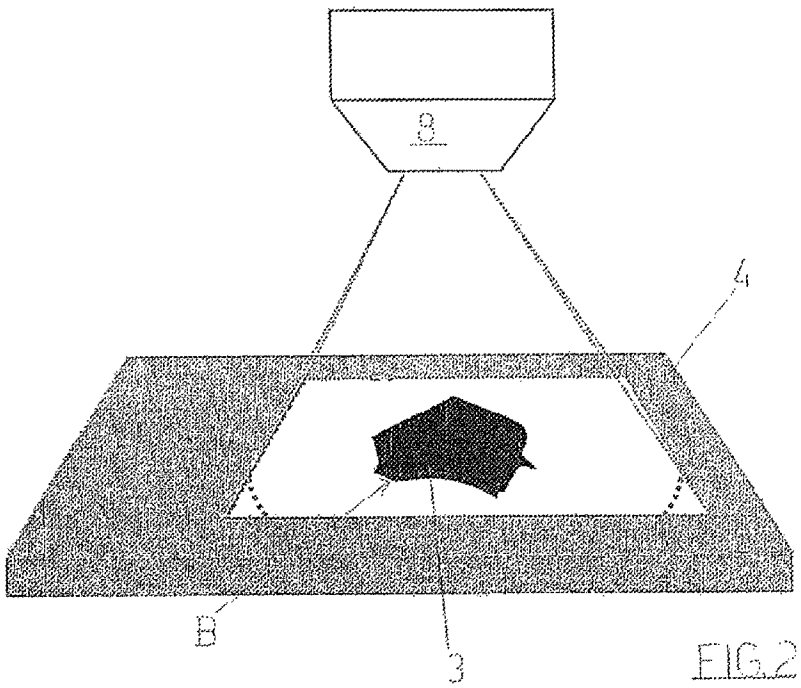

In particular, the method of the invention further comprises steps of: b) detecting the peripheral profile (P) of the model (2) with respect to a reference system and storing the peripheral profile (P) in a memory of a processing device (10);

c) detecting a (closed) profile (A) of the through-opening (20) and the relative positioning with respect to a reference system (which in a particular embodiment of the invention can be for example the peripheral profile (P) of the model (2) itself) and storing it in a memory of a processor device (10) (see FIG. 1);

d) predisposing the flat article (3) on a marking plane (4) (see FIG. 2);

e) detecting a peripheral profile (B) of the flat article (3) to be marked;

f) replicating (for example in the software program) the peripheral profile (P) of the model (2) detected on the marking plane (4), in such a way as to superpose it on the peripheral profile (B) of the flat article (3) to be marked;

g) replicating (for example in the software program) also the profile (A) of the through-opening (20) of the detected model (2) on the marking plane (4), taking account of the relative positioning with respect to a reference system (which might for example be the peripheral profile (P) of the model (2) itself) and taking account of the positioning of the peripheral profile (P) of the model (2) with respect to the peripheral profile (B) of the flat article (3);

h) contactless marking of at least a reference (5) on the flat article (3) at the profile (A) of the through-opening (20) which has been replicated (see FIG. 3).

In the sector, model (2) indicates a flat element usually made of cardboard, provided with one or more through-openings (20) (see FIG. 1A). In detail, the profile and positioning of each through-opening (20) corresponds to the positioning of a reference (5) to be marked on the corresponding flat article (3).

The flat article (3) to be marked can on the other hand typically but not exclusively be made of leather or a textile.

The term "reference" (5) can refer to continuous or discontinuous lines, as well as dots, broken lines, logos or codes, for example alphanumeric codes.

The reference system can be of any type, for example, a Cartesian system or a reference system defined by a plurality of markers so that one reference plane alone is made.

With the above-disclosed method, it is therefore possible to detect and memorise the peripheral profile (P) (i.e. the peripheral edge) of the model (2) (which can be arbitrarily arranged on the detecting plane (1)), and the various profiles (A) of all the relative through-openings (20).

Once a flat article (3) to be marked is arranged on the marking plane (4) (also arbitrarily) and once the peripheral profile (B) (i.e. the peripheral edge) has been detected, it will be possible to replicate on the marking plane (4) the peripheral profile (P) of the corresponding model (2), and the profile (A) of the relative through-opening (20) (or the relative through-openings): the marking of the reference (5) (or references) can be made on the flat article in reference to this.

Note that steps from d) to h) listed above do not necessarily have to be carried out immediately following steps from a) to c) as listed above, as will become more evident in the following example.

Take a case in which there is a plurality of flat articles (3) to be marked (for example leather or material articles) having peripheral profiles (B) that are different among themselves, and an equal plurality of corresponding models (2). In this case it is possible to proceed, for example, by performing for each model (2) steps from a) to c) listed above, and later to carry out, for each corresponding flat article (3), steps from d) to h) listed above (even in a different order with respect to the order in which the various models (2) have been processed).

In particular, in a preferred embodiment of the invention, the step of detecting the peripheral profile (P) of the model (2) and storing it in a processing device (10) (step b mentioned above) comprises a sub-step of detecting Cartesian coordinates of the points defining the peripheral profile (P) of the model (2) on a first Cartesian plane (possibly coinciding with the detecting plane (1)).

Further, again in relation to this preferred embodiment of the invention, the step of detecting the profile (A) of the through-opening (20) and the relative positioning with respect to a system of reference (which can also be connected to the peripheral profile (P) of the model (2)) and memorised in the memory of a processing device (10)) (step c mentioned above) comprises a sub-step of detecting Cartesian coordinates of the points defining the profile (A) of the through-opening (20) on the first Cartesian plane.

In the same way, the step of detecting the peripheral profile (B) of the flat article (3) to be marked (step e above) comprises a sub-step of detecting Cartesian coordinates of the points identifying the peripheral profile (B) of the flat article (3) on a second Cartesian plane (schematically illustrated for example in FIG. 3) (possibly coinciding with the marking plane (4)).

Likewise, the step of replicating the peripheral profile (P) of the model (2) on the marking plane (4), so as to superpose it on the peripheral profile (B) of the flat article (3) to be marked (step f listed above) comprises a sub-step (if necessary) of translating and (if necessary) rotating the peripheral profile (P) of the model (2), detected in the first Cartesian plane, in the second Cartesian plane, in such a way that it is superposed on the peripheral profile (B) of the flat article (3);

The step of replicating also the profile of opening of the model on the marking plane (step g above) can comprise a sub-step of translating (if necessary) and rotating (if necessary) the opening profile, detected in the first Cartesian plane into the second Cartesian plane.

In a further embodiment, the method further comprise a step of detecting a position of a centre of gravity both of the model (2) and of the flat article (3) to be marked at the marking plane (4).

The positions of the peripheral profile (P) of the model and the profile (A) of the flat article (3) will advantageously be even more precise.

In a preferred embodiment of the invention, the method further comprises, before step h), steps of verifying and possibly correcting (for example by software calibration) any errors or imprecisions due to optical distortion connected to steps from b) to g) as described above.

In other words, steps can be included of verifying and possibly correcting errors due to the replicating (for example in the software) the peripheral profile (P) of the model (2) on the marking plane (4) and/or replicating (for example in the software) the profile (A) of the through-opening (20) of the model (2) on the marking plane (4).

The invention further relate to a marking method for marking references (5) on a flat article (3), characterised in that it comprises steps of:

i) loading on a computer memory a peripheral profile (P) of a model (2) provided with a through-opening (20) and the profile (A) of the through-opening (20) (for example starting from CAD design sheets or data files); the model (2) exhibiting a same peripheral profile (P) as a flat article (3) to be marked;

j) predisposing the flat article (3) on a marking plane (4);

k) detecting the peripheral profile (B) of the flat article (3) to be marked;

l) replicating the peripheral profile (P) of the detected model (2) onto the marking plane (4), in such a way as to superpose the peripheral profile (P) on the peripheral profile (B) of the flat article (3) to be marked;

m) also replicating the profile (A) of the through-opening (20) of the model (2), loaded in the memory of a processor, taking account of the relative positioning with respect to a nominal reference system and taking account of the positioning of the peripheral profile (P) of the model (2) with respect to the peripheral profile (B) of the flat article (3);

n) contactless marking at least a reference (5) on the flat article (3) at the profile (A) of the through-opening (20) that has been replicated.

In other words, steps from a) to c) of the method described in the foregoing are replaced in this case by step i). The other variants and embodiments for the previously-described method can clearly be actuated and included also for the above-described method.

Figure 4:
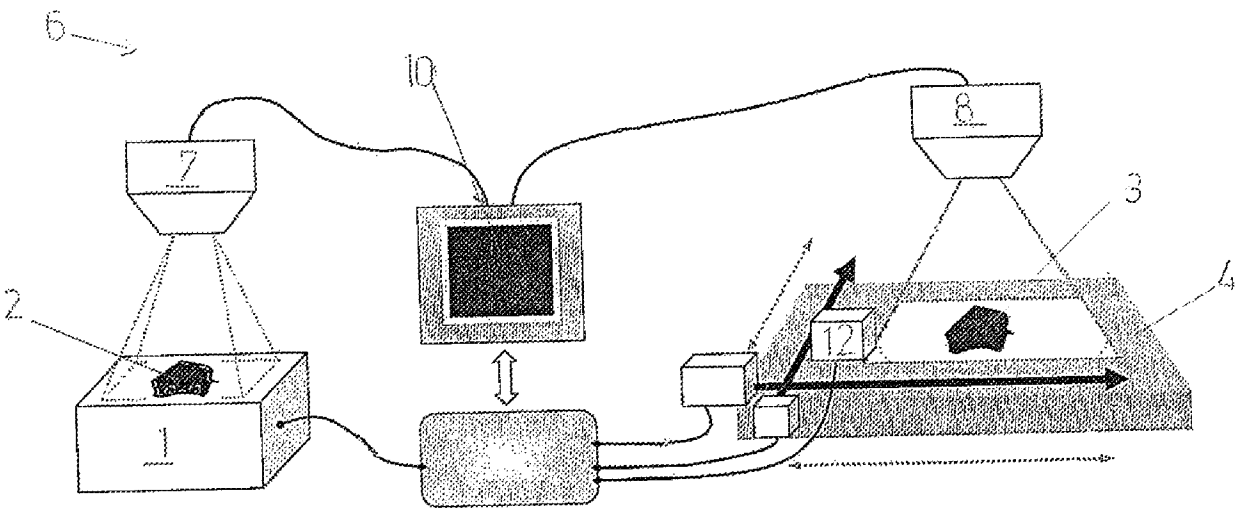
FIG. 4 schematically illustrates a system according to the invention.

The invention further relates to a system (6) for actuating the method described above (illustrated schematically in FIG. 4), comprising a detecting plane (1), for restingly receiving a model (2) provided with at least a through-opening (20);

In particular, the system (6) comprises: a first device for digitally acquiring images (7) (for example a first tv camera) for detecting the peripheral profile (P) of the model (2) and the profile (A) of the relative through-opening (20); a marking plane (4), for restingly receiving at least a flat article (3) to be marked; a second digital image-acquiring device 8 (for example a second tv camera) for detecting a peripheral profile (B) of the flat article (3) to be marked; a processing device (10), for storing and processing the peripheral profile (P) of the model (2) and the profile (A) of the through-opening (20) detected on the detecting plane (1), and for replicating the peripheral profile (P) of the model (2) and the profile (A) of the relative through-opening (20) on the marking plane (4) so that the peripheral profile (P) of the model (2) is superposed on the peripheral profile (B) of the flat article (3) to be marked; contactless marking means (12), for marking at least a reference (5) on the flat article (3) at the profile (A) of the through-opening (20) which has been replicated.

Obviously the detecting plane (1) and the marking plane (4) can be arranged in two different environments that are distant from one another.

In a preferred embodiment of the invention, the contactless marking means (12) comprise an inkjet printing or marking system (for example an inkjet printer). This detail advantageously enables maintaining the total costs particularly modest, reducing the performance times of each marking operation and therefore increasing system productivity.

In a variant, the contactless marking means (12) can comprise a laser printing or marking system (for example a laser printer).

In a further variant, the contactless marking means (12) can comprise a spray marking system (for example a spray marking system with a controlled spray) with mono and/or bi-component fluids, including photosensitive or heat-sensitive fluids.

The system (6) can further comprise first lighting means (not illustrated) predisposed to illuminate the detecting plane (1), and second lighting means (not illustrated) predisposed to illuminate the marking plane (4).

This specification advantageously enables greater precision in the operations of realising (detecting, replicating, marking etc.), thanks also to the possibility of a chromatic recognition of the flat article (3), and thus having a positive impact on the quality of the finished product.

With the method and the system of the invention, it is no longer necessary for an operator to manually superpose a model on a flat article with the aim of marking references thereon, as happened in the prior art. With the invention, therefore, the quality and the precision of the reference marking on a flat article are no longer influenced by the experience of an operator.

The above-described is understood to have been described by way of non-limiting example, and any constructional variants thereof are understood to fall within the scope of the invention.

The invention claimed is:

1. A system for actuating a method, for marking reference signs on a flat article, where the method comprises:

providing a flat article to be marked, the flat article to be marked having a peripheral profile;

loading into a computer memory a peripheral profile of a model provided with a through-opening and loading into the computer memory the profile of the through-opening, the peripheral profile of the model being the same as and corresponding to the peripheral profile of the flat article to be marked;

predisposing the flat article to be marked on a marking plane;

detecting the peripheral profile of the flat article predisposed on the marking plane;

replicating on the marking plane wherein the article to be marked is predisposed the peripheral profile of the model loaded in the computer memory, in such a way as to superpose the peripheral profile of the model on the peripheral profile of the flat article;

also replicating on the marking plane the profile of the through-opening of the model, loaded in the computer memory, on the marking plane, taking account of the relative positioning with respect to a nominal reference system and taking account of the positioning of the peripheral profile of the model with respect to the peripheral profile of the flat article;

contactlessly marking at least one reference sign on the flat article at the profile of the through-opening that has been replicated, the system comprising:

a detecting plane, for restingly receiving a model provided with at least one through-opening;

a first digital uploading system of images for detecting the peripheral profile of the model of the profile of the at least one through-opening;

a marking plane for restingly receiving a flat article to be marked;

a second digital uploading system of images, for detecting the peripheral profile of the flat article to be marked;

a processing device, comprising in turn a memory, for storing the peripheral profile of the model and the profile of the at least one through-opening detected on the detecting plane, and for replicating the peripheral profile of the model and the profile of the at least one through-opening on the marking plane, in such a way that the peripheral profile of the model is superposed on the peripheral profile of the flat article to be marked and for managing the whole marking operation;

contactless marking means for marking at least one reference sign on the flat article at the profile of the at least one through-opening of the model.

2. The system of claim 1, wherein the contactless marking means comprise an inkjet printing system.

3. The system of claim 1, wherein the contactless marking means comprise a laser printing system.

4. The system of claim 1, wherein the contactless marking means comprise a controlled-spray marking system.

5. The system of claim 1, further comprising first lighting means predisposed to illuminate the detecting plane, and second lighting means predisposed to illuminate the marking plane so as to facilitate chromatic recognition of the flat article.

6. The system of claim 1, wherein the detecting plane and the marking plane are arranged in two different environments that are distant from one another.

7. A system for actuating a method for marking reference signs on a flat article, wherein the method comprises:

providing a flat article to be marked, the flat article to be marked having a peripheral profile;

a) predisposing, on a detecting plane, a model having a peripheral profile and provided with at least one through-opening, the peripheral profile of the model being the same as and corresponding to the peripheral profile of the flat article to be marked;

b) detecting the peripheral profile of the model with respect to a reference system and storing the peripheral profile of the model in a memory of a processing device;

c) detecting a profile of the at least one through-opening and the relative positioning thereof with respect to a reference system;

d) predisposing the flat article to be marked on a marking plane;

e) detecting the peripheral profile of the flat article predisposed on the marking plane;

f) replicating on the marking plane wherein the article to be marked is predisposed the detected peripheral profile of the model in such a way as to superpose the peripheral profile of the model on the peripheral profile of the flat article;

g) replicating on the marking plane also the detected profile of the at least one through-opening of the model, taking account of the relative positioning with respect to a reference system and taking account of the positioning of the peripheral profile of the model with respect to the peripheral profile of the flat article;

h) contactlessly marking at least one reference sign on the flat article at the profile of the at least one through-opening which has been replicated the system comprising:

a detecting plane, for restingly receiving a model provided with at least a through-opening;

a first digital uploading system of images for detecting the peripheral profile of the model of the profile of the through-opening; a marking plane for restingly receiving a flat article to be marked; a second digital uploading system of images, for detecting the peripheral profile of the flat article to be marked;

a processing device, comprising in turn a memory, for storing the peripheral profile of the model and the profile of the through-opening detected on the detecting plane, and for replicating the peripheral profile of the model and the profile of the relative opening on the marking plane, in such a way that the peripheral profile of the model is superposed on the peripheral profile of the flat article to be marked and for managing the whole marking operation; contactless marking means for marking at least a reference on the flat article at the opening profile of the model.

8. The system of claim 7, wherein the contactless marking means comprise an inkjet printing system.

9. The system of claim 7, wherein the contactless marking means comprise a laser printing system.

10. The system of claim 7, wherein the contactless marking means comprise a controlled-spray marking system.

11. The system of claim 7, further comprising first lighting means predisposed to illuminate the detecting plane, and second lighting means predisposed to illuminate the marking plane so as to facilitate chromatic recognition of the flat article.

12. The system of claim 7, wherein the detecting plane and the marking plane are arranged in two different environments that are distant from one another.

* * * * *